United States Patent [19]

Field

[11] Patent Number: 4,672,757

[45] Date of Patent: Jun. 16, 1987

[54] DISPLAY SYSTEM

[76] Inventor: Frank P. Field, 854 Napoli Dr., Pacific Palisades, Calif. 90272

[21] Appl. No.: 599,196

[22] Filed: Apr. 11, 1984

[51] Int. Cl.[4] ..... G09F 3/18

[52] U.S. Cl. ..... 40/10 R; 40/16.4; 40/618

[58] Field of Search ..... 40/10, 16, 16.1, 152.1, 40/16.4

[56] References Cited

U.S. PATENT DOCUMENTS

| | | | |
|---|---|---|---|
| 640,943 | 1/1900 | Poehlmann | 40/16.6 |
| 1,915,116 | 6/1933 | Barrett | 40/16.6 |
| 2,161,193 | 6/1939 | Phillips | 40/618 |
| 2,197,657 | 4/1940 | Chrchill | 40/16.6 |
| 2,588,635 | 3/1952 | Junkin | 40/618 |
| 2,827,716 | 3/1958 | Howard | 40/16.6 |
| 3,154,870 | 11/1964 | Hopp et al. | 40/16.4 |
| 3,220,125 | 11/1965 | Wende | 40/16.4 |
| 3,313,054 | 4/1967 | Madey | 40/16.6 |
| 3,458,945 | 8/1969 | Edwards | 40/618 |
| 3,877,163 | 4/1975 | Bissonet | 40/16.4 |

FOREIGN PATENT DOCUMENTS

| | | | |
|---|---|---|---|
| 408628 | 9/1966 | Switzerland | 40/16.4 |

*Primary Examiner*—Gene Mancene
*Assistant Examiner*—Wenceslao J. Contreras
*Attorney, Agent, or Firm*—Stetina and Brunda

[57] ABSTRACT

This invention relates to display systems for holding header cards for displaying information about merchandise being offered for sale. The invention includes header card holders that provide easy assembly and disassembly for use with vertically slotted walls or horizontally slotted walls. The display system further includes a header card holder that may be conveniently placed on a horizontal surface and a header card holder that may be mounted to an edge of the wall.

1 Claim, 15 Drawing Figures

Fig. 7
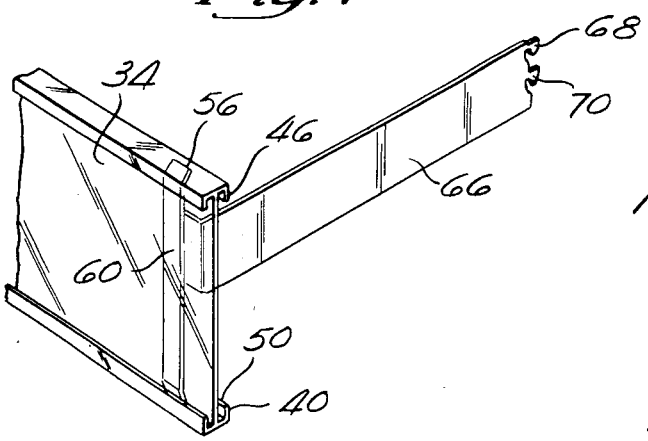
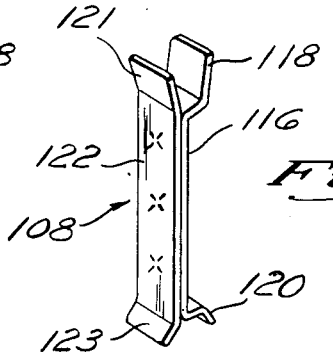
Fig. 8
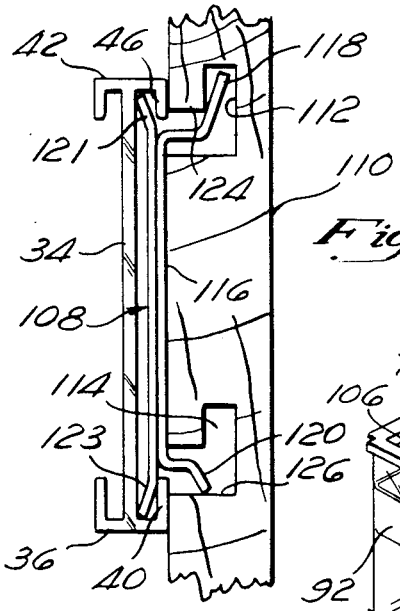
Fig. 10
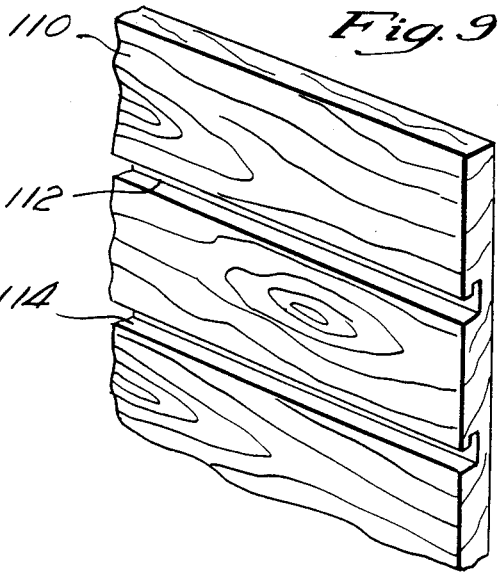
Fig. 9
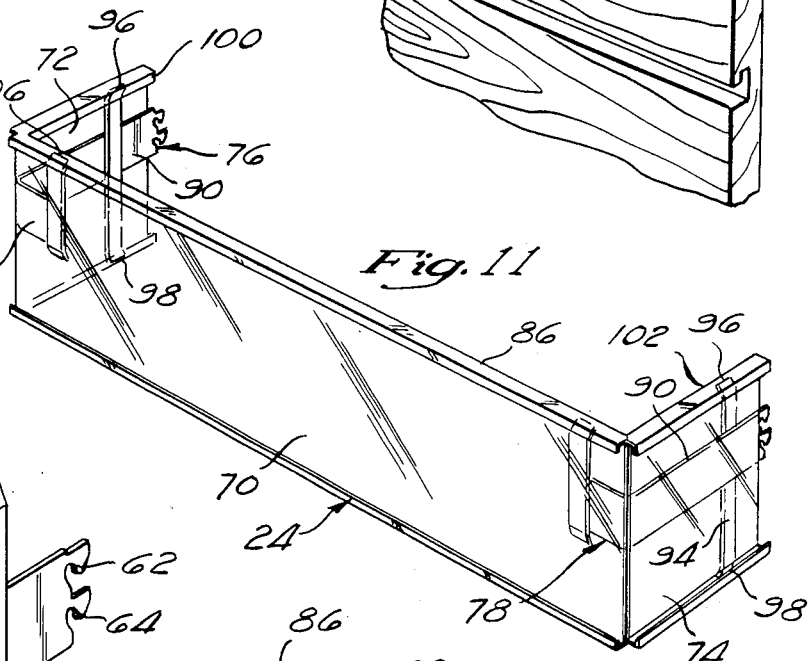
Fig. 11
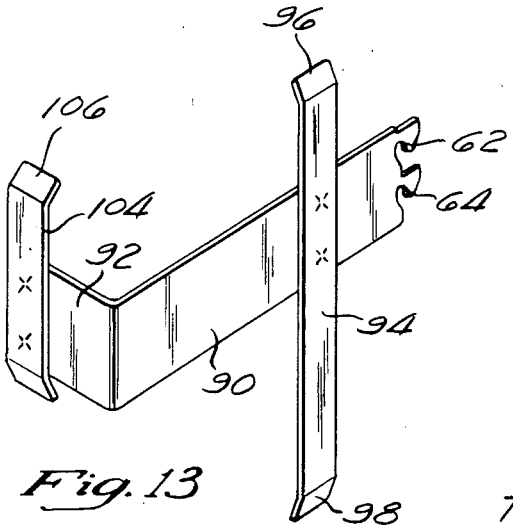
Fig. 13
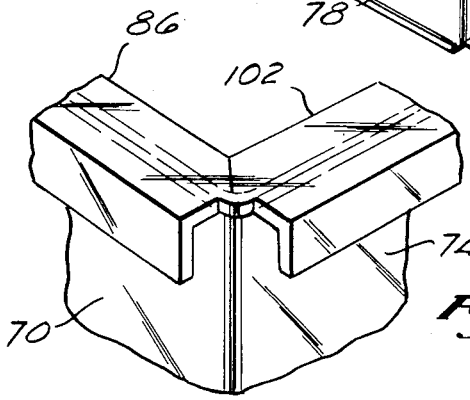
Fig. 12

DISPLAY SYSTEM

BACKGROUND OF THE INVENTION

This invention relates generally to display systems and more particularly to display systems including apparatus for holding header cards for displaying information about merchandise being offered for sale.

A variety of methods and devices have been utilized to inform consumers of product prices, characteristics, or special sales or features of merchandise in conjunct with the display of the goods. In instances where it is inappropriate to mark the goods directly or when it is desirous to display supplemental announcements in conjunction with the goods, a particular method has been devised which utilizes a transparent cardholder that is self-supporting and generally placed in close proximity to the goods. A typical example of such a device is a clear plastic sheet into which an inverted U-shaped fold has been placed in the center. In use, the inverted U-shaped fold includes a base portion formed of the flat ends of the sheet to lie flat on a surface to serve as support for the device. Cards are then placed in the fold from the side and are supported by resting on the counter surface. Although the device has proven useful in many applications, there are inherent difficulties in its use.

Since these display devices are frequently moved, the card which normally rests on the support surface often falls from the device when it is moved. Because of the nature of the formation of the fold (i.e., heat formed), the distance between the ends cannot be precisely controlled. In addition, the distance between the surfaces of the inverted U-shaped fold is often so small that it is in difficult to place and remove the cards.

Also, in many instances, it is desirable to place additional information in the device without removing the original advertisement, for example, information concerning special sale prices. In the conventional prior art, the additional information, referred to as a "header" would necessarily obscure a portion of the original advertisement. Further, since the fold-over device is normally constructed of a single piece, the stand or base portion is an integral part of the device and requires a flat surface on which to rest.

For these and other reasons, there exists a need for a display system that is easy to use, provides for easy placement and removal of the cards, may accommodate additional information such as a header without obscuring the original advertisement, and that has the capability of displaying the advertisements at differing locations relative the merchandise.

SUMMARY OF THE INVENTION

This invention overcomes the deficiencies of previous display systems by providing a display system including header card holders that provide easy assembly and disassembly for mounting to a pair of rows of vertical slots or to a wall having a plurality of parallel horizontal slots therein. The display system further includes a header card holder that may be conveniently placed on a horizontal surface and a header card holder that may be mounted to an edge of a wall.

A header card holder included in the invention includes a generally rectangular panel having pairs of legs extending from a pair of opposite edges to form channels for holding header cards. The edges of the header card holder fit into a slot in a supporting base that may be placed in any convenient location.

The invention includes brackets for mounting the panel to a pair of rows of vertical slots, which may be conveniently formed in a pair of rails, and for mounting the panel to a wall having a plurality of parallel slots therein. The bracket includes a plurality of hooks for engaging the vertical slots and a cross member including a pair of retainers for engaging edges of the horizontal slots to retain the header card holder in a desired position. The bracket includes a cross member having a pair of retainers for engaging the edges of channels formed on the panel to firmly attach the panel to the bracket to prevent accidental removal while still permitting unskilled personnel to assemble and disassemble the system without the use of tools.

The invention also includes a header card holder comprising a generally rectangular front panel and a pair of generally equal length rectangular side panels and a bracket including cross emmbers with corresponding retainers thereon for engaging the front and side panels to support the weight of the header card holder.

The system additionally includes a header card holder including a panel and a base extending from one edge thereof. The base includes a pair of legs that may be slightly spread apart to receive an edge of a wall therebetween. The legs grip the sides of the wall to retain the header card holder in the desired position. The header card holder includes a pair of channels formed to receive header cards therein.

All of the panels included in the invention are preferably formed of a strong, durable, somewhat flexible transparent material such as polycarbonate.

BRIEF DESCRIPTION OF THE DRAWINGS

FIG. 7 is a perspective view illustrating a second embodiment of a bracket that may be used to connect the header card holder of FIG. 5 to a vertically slotted wall;

FIG. 8 is a perspective view of a bracket for mounting the header card holder of FIG. 5 to a horizontally slotted wall;

FIG. 9 is a perspective view illustrating a horizontally slotted wall suitable for mounting the bracket of FIG. 8;

FIG. 10 is an end view of the bracket of FIG. 8 and the wall of FIG. 9 having the bracket mounted in a pair of slots in the wall;

FIG. 11 is a perspective view of a third embodiment of a header card holder and mounting brackets that may be included in the display system of FIG. 1;

FIG. 12 is a perspective view showing a corner of the header card holder of FIG. 11 in an expanded scale;

FIG. 13 is a perspective view showing one of the brackets of FIG. 11 in an expanded scale;

DESCRIPTION OF THE PREFERRED EMBODIMENT

Figure 1:
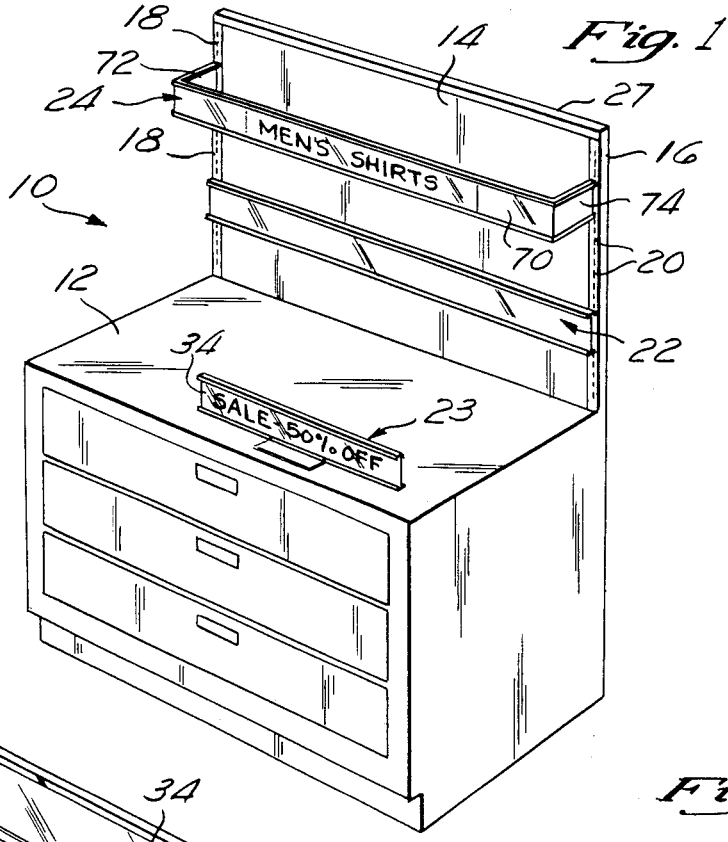
FIG. 1 is a perspective view of a display system according to the invention.
Figure 15:
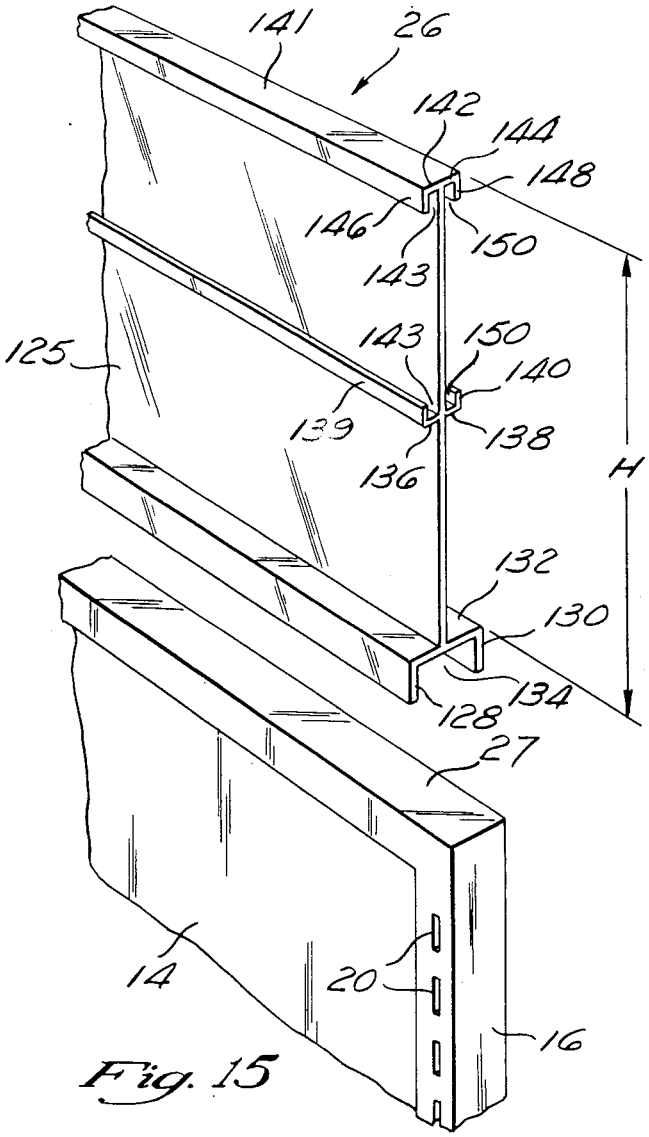
FIG. 15 is a perspective view of a fourth embodiment of a header card holder that may be included in the display system of FIG. 1.

Referring to FIG. 1, a display assembly 10 includes a display case 12 having an upright wall 14. A pair of rails 16 and 18 (conventionally known as vertical slot) having a plurality of slots 20 therein are mounted to the wall 14 near opposite ends of the display case 10. The rails 16 and 18 are preferably parallel to one another and vertically oriented. A pair of header card holders 22 and 24 are mounted to the wall 14. Referring to FIG. 15, a header card holder 26 may be attached to the upper edge 27 of the wall 14. A header card holder 23 may be positioned on the display case 12. The header card holders 22, 23, 24 and 26 are preferably primarily formed of a relatively light-weight transparent material such as polycarbonate. General Electric sells a suitable material for forming the header card holders 22, 23, 24 and 26 under the trademark Lexan. The header card holders 22, 23, 24 and 26 may be formed by extrusion of any suitable plastic material.

Figure 3:
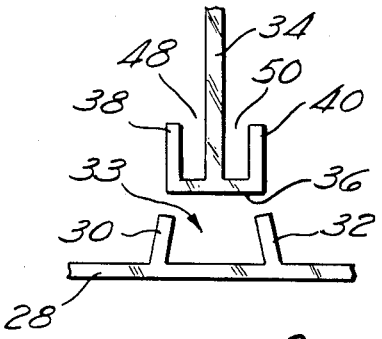
FIG. 3 is an end view of the header card holder of FIG. 2.
Figure 2:
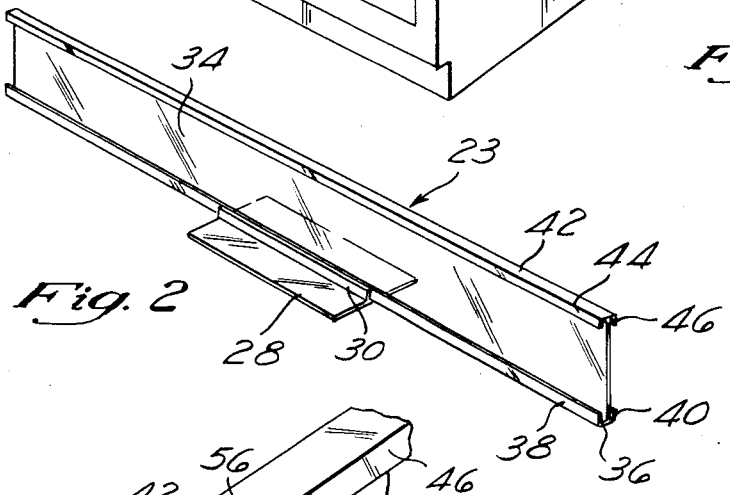
FIG. 2 is a perspective view showing a first embodiment of a header card holder that may be included in the display system of FIG. 1 in an expanded scale.
Figure 4:
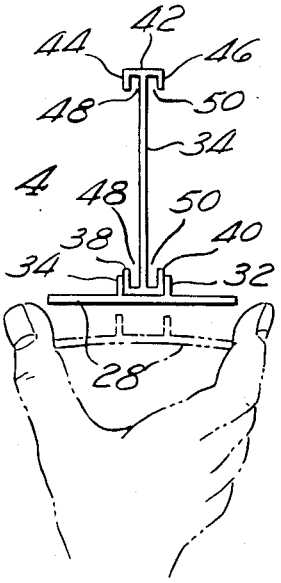
FIG. 4 is an end view showing a preferred method of assembling the header card holder of FIG. 2.
Figure 14:
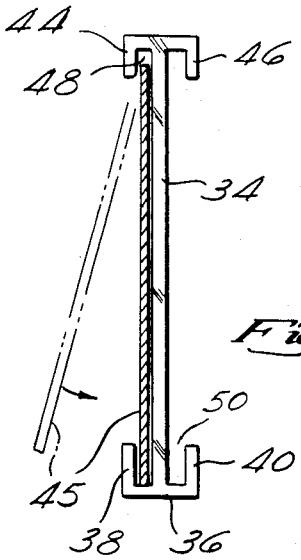
FIG. 14 is a partial cross sectional view of the header card holder of FIG. 2 showing a header card mounted in a channel.

As best shown in FIGS. 2, 3 and 4, the header card holder 23 includes a generally rectangular base plate 28 with a pair of legs 30 and 32 projecting therefrom. The header card holder 23 also includes a generally rectangular panel 34 with a base 36 extending therefrom. The legs 30 and 32 form a slot 33 that extends longitudinally along the base 28 for receiving the base 36 therein. A pair of legs 38 and 40 extend generally perpendicularly from the base 36. The legs 38, 40 are formed to fit closely within the slot 33. Preferably the plate 28 must be flexed slightly as shown in FIG. 4 to widen the slot 33 so that the legs 38, 40 may be inserted therein. A second base 42 and a pair of legs 44, 46 similar to the base 36 and the legs 38, 44 extend from the rectangular panel 34. The legs 38 and 44 extend in opposite directions to form a channel 48 for retaining the edges of a header card 45, shown in FIG. 14, on one side of the header card holders 22 and 23. Similarly, the legs 40 and 46 form a channel 50 for retaining the edges of a header card (not shown) on the opposite side of the header card holders 22 and 23.

Figure 5:
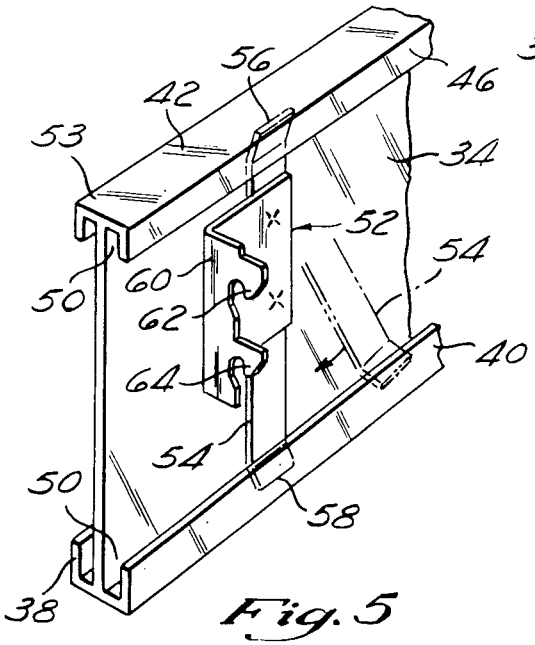
FIG. 5 is a perspective view showing a bracket and method of attaching the bracket to a second embodiment of a header card holder that may be included in the display system of FIG. 1.
Figure 6:
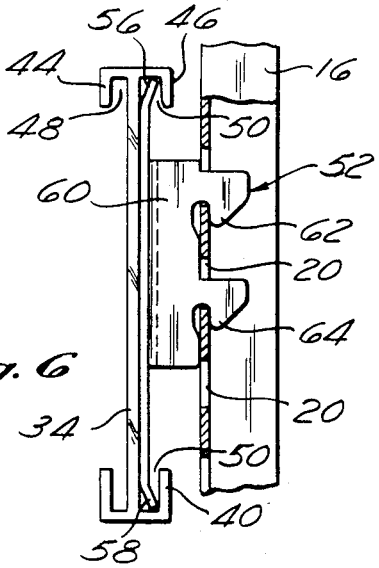
FIG. 6 is a partial cross sectional view showing the bracket of FIG. 5 mounted to a vertically slotted rail.

Referring to FIGS. 1, 5, 6 and 7, the rectangular panel 34 may be mounted to the rails 16 and 18, which are mounted to the wall 14. FIG. 5 illustrates a bracket 52 mounted near an end 53 of the panel 34. The bracket 52 includes a cross member 54 having a pair of retainers 56 and 58 extending therefrom. The retainers 56 and 58 engage the panel 34 and the legs 40 and 46, for example, to mount the panel 34 to the bracket 52. Preferably, the retainer 56 is first engaged with the leg 46 with the end thereof against the base 42, and the retainer 58 is then rotated into the desired position. Preferably the retainers 56 and 58 are firmly engaged in the channel 50 sufficiently to retain the panel 34 against movement relative to the bracket 52.

The bracket 52 includes a plate 60 attached to the cross member 54. The plate 60 has a generally L-shaped cross section and has a pair of spaced apart hooks 62 and 64 extending therefrom for engaging selected slots 20 in the rail 16. A second bracket (not shown) similar to the bracket 52 mounts the other end of the panel 34 to the other rail 18. As shown in FIG. 7, the plate 60 may include an elongate arm 66 having hooks 68, 70 attached thereto for mounting the panel 34 spaced apart from the wall 14.

Referring to FIGS. 1, 11 and 12, the header card holder 24 is preferably formed of a generally retangular front panel 70 and a pair of generally rectangular side panels 72 and 74. A pair of brackets 76 and 78 mounted to the front panel 70 and side panels 72 and 74, respectively, attach the header card holder 22 to the rails 16 and 18. The length of the side panels 72 and 74 may vary from about an inch to 18–24 inches or more depending upon where the front panel 70 with the header card mounted thereon is desired to be located. the side panels 72 and 74 are preferably integrally formed with the front panel 70. The front panel 70 formed by extruding and heated so that the side panels may be formed by bending the front panel 70 along a pair of parallel lines that are equally spaced from the ends of the front panel 70.

The brackets 76 and 78 are preferably demountably attached to the header card holder 24. FIGS. 11 and 13 show a preferred configuration of the brackets 76 and 78. Since the brackets 76 and 78 are of similar construction, only the bracket 76 will be described in detail.

The front panel 70 is formed to have an inwardly extending 86 and the side panels 72 and 74 have similar lips 100 and 102, respectively. The bracket 76 includes a first arm 90 that is dimensioned to extend the length of the side panel 72. A second arm 92 extends perpendicularly from the first arm 90 to form a generally L-shaped structure. A cross member 94 connected to the first arm 90 has a pair of retainers 96 and 98 extending therefrom. The retainers 96 and 98 extend away from the plane of the side panel 72 to engage a pair of legs 100 and 102, respectively, that are similar to the legs 32 and 46. The length of the cross member 94 is such that it fits securely between the legs 100 and 102. The cross member 90 is preferably mounted between the legs 100 and 102 in a manner similar to that described above for mounting the cross member 54 to the panel 34. A cross member 104 having a retainer 106 thereon extends from the arm 92. When assembled to the header card holder 24 as shown and described, the brackets 76 and 78 provide adequate support for side panels 72 and 74 having lengths of 18–24 inches or more depending upon the strength and rigidity of the brackets 76 and 78, the arms 90 and the cross members 94 and 104.

Referring to FIGS. 8–10, the display system 10 may also include a bracket 108 for mounting the header card holder 24 to a wall 110 having parallel rows of slots 112 and 114 therein. The bracket 108 includes a plate 116 having a pair of retainers 118 and 120 extending therefrom for engaging the slots 112 and 114, respectively. The bracket 108 includes a second plate 122 having a pair of retainers 121 and 123 for engaging the legs 40 and 46, respectively, and the corresponding bases 36 and 42 of the panel 34.

FIG. 10 shows a cross section of the wall 110 (conventionally known as slot wall) and details of the configurations of the horizontally extending slots 112 and 114. The upper slot 112 has a generally L-shaped cross section so that the wall 110 includes an overhang 124. The retainer 118 is inserted into the slot 112 a distance sufficient to permit placement of the retainer 120 in the slot 114, which includes a shoulder portion 126 engaged with the retainer 120. The shoulder 126 supports the weight of the bracket 108 and attached panel 34. When the retainer 120 rests on the shoulder 126, the overhang 124 restrains the retainer 118 against rotation away from the wall 110.

Referring to FIG. 15, the header card holder 26 includes generally rectangular portion 125. A pair of legs 128 and 130 extend from a base portion 132, which is generally perpendicular to the plane of the rectangular portion 125 to form a slot 134. The slot 134 is dimensioned to fit securely upon the wall 14 to support the header card holder 26 thereon.

A pair of lips 136 and 138 extend the length of the header card holder 26, preferably approximately bisecting the height, H, thereof. The lips 136 and 138 have projections 139 and 140, respectively, that are generally parallel to the header card holder 26 and that are directed oppositely to the legs 128 and 130. A pair of lips 142 and 144 including a pair of projections 146, 148, respectively, extend from the upper edge 141 of the header card holder 26, parallel to the lips 136 and 138. The lips 136 and 142 cooperate to form a channel 143 for retaining a header card (not shown) for displaying information concerning merchandise that may be contained in the display tray 22. The lips 38 and 44 cooperate to form a second channel 150 for holding a header card (not shown) back to back with the header card retained between the lips 36 and 42.

Both types of brackets 52 and 108 permit rapid assembly and disassembly of the various embodiments of the display assembly 10 so that unskilled personnel are easily able to use the system for displaying merchandise in varying display applications to meet the diversity of modern merchandising techniques.

What is claimed is:

1. A display system for displaying objects such as merchandise for sale, comprising:

a header card holder, said header card holder formed as an elongate panel having a generally rectangular surface, a first pair of legs extending from opposite sides on one edge of said rectangular surface to form a first channel for receiving a pair of edges of a header card and a second pair of legs extending from opposite sides on the opposite edge of said panel to form a second channel, said pairs of legs disposed so that said header card holder has a symmetrical design about said rectangular surface whereby said pairs of legs may slidingly receive a header card on opposite sides of a rectangular surface; and means for mounting the header card holder to a wall, said mounting means comprising means for engaging said pairs of legs on one side of said rectangular surface and means for mounting the header card holder to a vertically slotted wall:

said elongate panel including a front panel and a pair of side panels substantially perpendicular to the front panel, at least one of the side panels including a third pair of legs extending therefrom to form a third channel and wherein the mounting means includes a bracket having a first arm and a second arm, the first arm having a plurality of hooks extending from one end thereof for directly engaging the slotted wall and a first cross member for engagement with a pair of opposing edges of the third channel, the second arm having a second cross member for engaging an edge of the second channel to support the weight of the header card holder.

* * * * *